United States Patent [19]

Kost et al.

[11] 4,347,969

[45] Sep. 7, 1982

[54] TRAY

[75] Inventors: William E. Kost; Norman Schoenberger, Jr., both of Norman, Fla.

[73] Assignee: Weyerhaeuser Company, Tacoma, Wash.

[21] Appl. No.: 261,831

[22] Filed: May 8, 1981

[51] Int. Cl.[3] ..... B65D 5/06

[52] U.S. Cl. ..... 229/34 HW; 229/27; 229/34 R

[58] Field of Search ..... 229/34 R, 34 HW, 27, 229/17 R, 31 R

[56] References Cited

U.S. PATENT DOCUMENTS

| | | | |
|---|---|---|---|
| 2,319,919 | 5/1943 | Clark | 229/34 R |
| 2,744,675 | 5/1956 | Crane . | |
| 2,903,176 | 9/1959 | Crane | 229/34 HW |
| 3,036,753 | 5/1962 | Davis et al. | 229/31 R |
| 3,074,615 | 1/1963 | Johnson . | |
| 3,194,472 | 7/1965 | Crane . | |
| 4,018,377 | 4/1977 | Kent et al. | 229/27 |
| 4,058,249 | 11/1977 | Buck | 229/34 HW |

FOREIGN PATENT DOCUMENTS

| | | | |
|---|---|---|---|
| 1514346 | 6/1978 | United Kingdom | 229/34 HW |

*Primary Examiner*—William Price
*Assistant Examiner*—Gary E. Elkins
*Attorney, Agent, or Firm*—Weyerhaeuser Company

[57] ABSTRACT

A tray which may be set up in the field and locked into position without the use of glue or staples. A pair of end panels are provided on each end of the tray. One of these end panels extends from the bottom panel of the tray and the other extends from the upper panel of the tray. One is an exterior end panel and the other is an interior end panel. The exterior end panel has a pair of locking flaps which fold around the interior end panel and are held in place by a locking panel. The locking panel is hinged to the upper wall of the tray and folds down against the locking flaps holding the locking flaps against the interior end panel and locking the various members of the end wall into place. The locking panel is held in place by locking tabs in the panel which extend into apertures in the base panel of the tray.

14 Claims, 6 Drawing Figures

TRAY

BACKGROUND OF THE INVENTION

1. Field of the Invention

A tray construction having an interlocking end construction which holds the end walls in place.

2. Description of Other Patents

Crane, U.S. Pat. No. 2,744,675 granted May 8, 1956, Davis, et al, U.S. Pat. No. 3,036,753 granted May 29, 1962, Johnson, U.S. Pat. No. 3,074,615 granted Jan. 22, 1963, and Crane, U.S. Pat. No. 3,194,472 granted July 13, 1965 are exemplary of patents disclosing tray structures.

SUMMARY OF THE INVENTION

The purpose of the present invention is to provide a tray which may be set up in the field and locked into position without the use of glue or staples. A pair of end walls are provided on each end of the tray. One of these end walls extends from the base panel of the tray and the other extends from the upper panel of the tray. One is an exterior end wall and the other is an interior end wall. The exterior end wall has a pair of locking flaps which fold around the interior end wall and are held in place by a locking partition. The locking partition is hinged to the upper panel of the tray and folds down against the locking flaps holding the locking flaps against the interior end wall and locking the various members of the end wall into place. The locking partition is held in place by locking tabs on the partition which extend into apertures in the base panel of the tray.

BRIEF DESCRIPTION OF THE DRAWINGS

FIG. 4 is an upper view and FIG. 5 is a lower view of the tray.

DESCRIPTION OF THE PREFERRED EMBODIMENT

Figure 1:
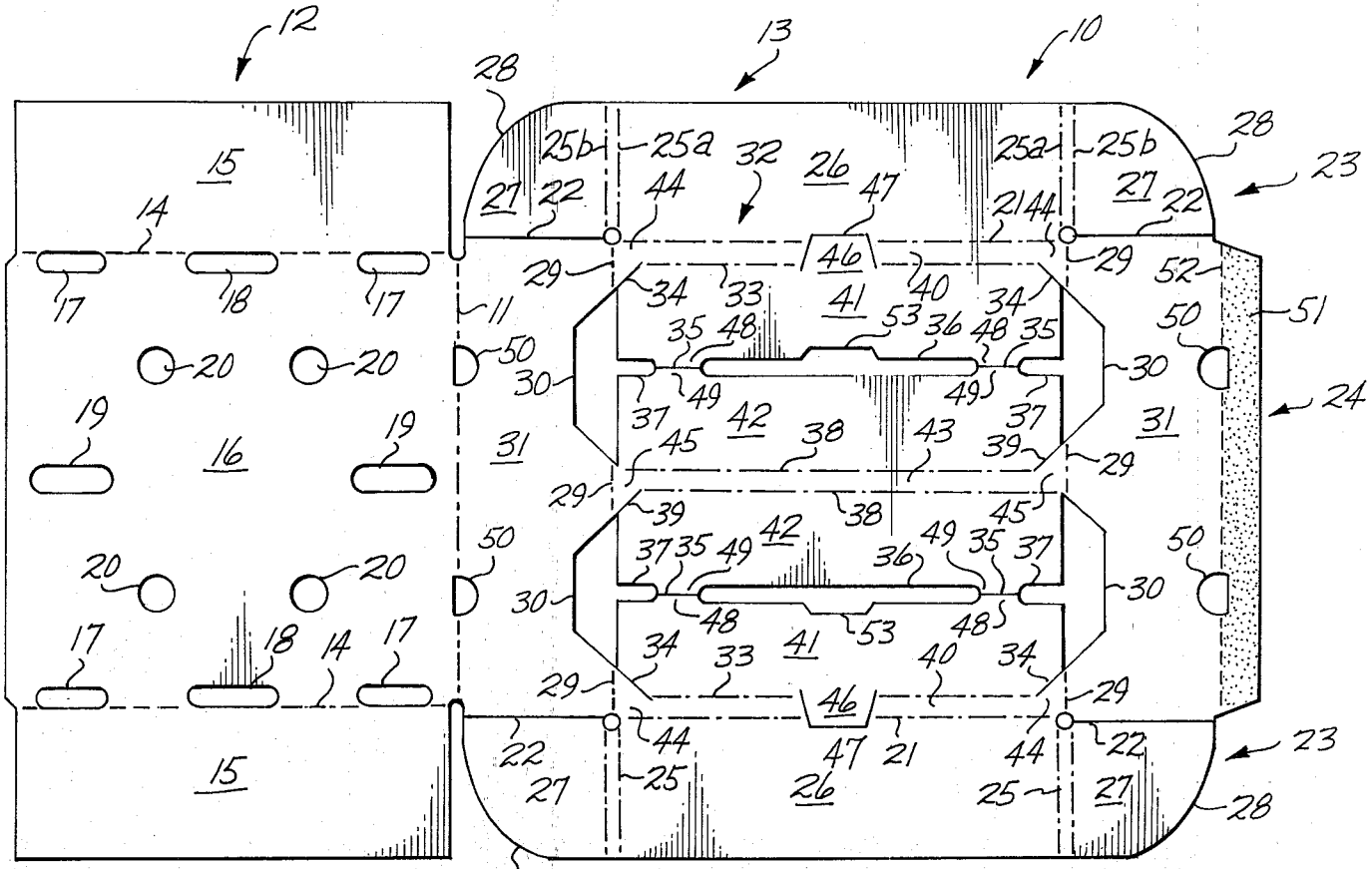
FIG. 1 is a top plan view of the blank for the tray.

FIG. 1 shows a blank 10 which is divided by a longitudinal score line 11 into a base section 12 and an upper section 13. The blank material is normally double faced corrugated and the score line 11 runs in the direction of the corrugations.

The base section 12 is divided by a pair of first transverse score lines 14 into two interior end walls 15 and a base panel 16. The interior end walls 15 are hinged to the ends of the base panel 16 along the transverse score lines 14. There are a number of apertures in the base panel 16. Located along each of the score lines 14 are a pair of exterior locking apertures 17 and a central stacking aperture 18. The locking apertures 17 along one score line 14 are aligned with the locking apertures 17 along the other score lines and the stacking apertures 18 are aligned longitudinally of the container also. Located centrally of the base panel 16 are another pair of locking apertures 19. These are also aligned with the locking apertures 17. A number of air holes 20 are also located in the base panel 16.

Upper section 13 is divided by a pair of second transverse perforated score lines 21 and aligned cuts 22 extending outwardly from each end of the score lines 21 into a pair of upper end sections 23 and an upper central section 24. The end sections 23 are hinged to the central section 24 along the second transverse score lines 21.

Each of the end sections 23 is divided by a pair of longitudinal double perforated score lines 25 into an exterior end wall 26 and a pair of locking flaps 27 hinged to the side edges of the exterior end wall 26 along the score lines 25. The pair of score lines 25 in one end section 23 is aligned with the pair of score lines 25 in the other end section. The two score lines in each pair are spaced from each other the width of the material forming the interior end panel to allow the locking flaps to be wrapped around the interior end walls. The outer edges 28 of the locking flaps 27 are curved to allow them to be inserted into the tray when the exterior end walls 26 are bent downwardly from the plane of the top of the tray.

The upper central section 24 is divided by a pair of substantially parallel aligned score lines 29 and apertures 30 into a pair of side walls 31 and an upper tray section 32.

The upper tray section 32 is divided by outer score lines 33 and their exterior cut lines 34, partition cuts 35 and their aligned central apertures 36 and exterior apertures 37, and interior score lines 38 and their exterior cut lines 39 into outer upper panels 40, locking partitions 41, central partitions 42 and central upper panel 43. The locking partitions 41 are hinged to the outer upper panels 40 along score lines 33 and the central partitions 42 are hinged to the central upper panel 43 along score lines 38. Cuts 34 form ledges 44 in the upper corners of the tray and cuts 39 form ledges 45 centrally of the tray. Stacking tabs 46 are formed in the upper edge of locking partitions 41 by the U-shaped cuts 47 which extend through the outer upper panels 40. Locking tabs 48 and 49 are formed on the lower edges of the locking partitions 41 and central partitions 42, respectively, by the cut lines 35 and the adjoining apertures 36 and 37.

Air vents 50 are formed in the lower edges of side walls 31.

A glue flap 51 is hinged to the lower edge of free side wall 31 along score line 52.

A lay flat blank for the tray may be formed by bending the container around certain of the longitudinal score lines such as the longitudinal score line 29 and its adjacent score lines 25 and adhering glue flap 51 to the interior face of base panel 16.

Figures 2, 3:
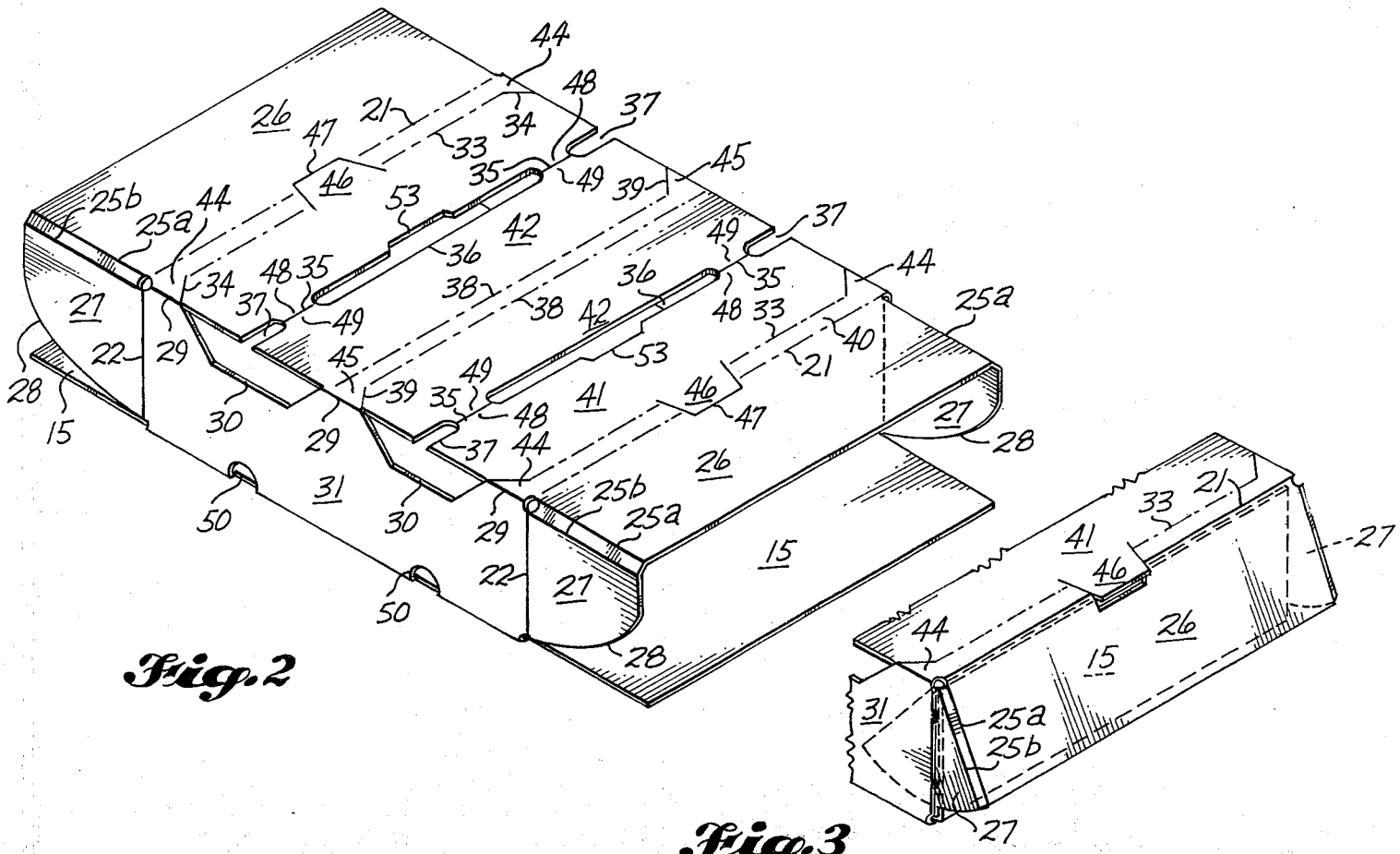
FIG. 2 is an isometric view of the set up tray before being folded into a tray construction.
FIG. 3 is an isometric view showing the exterior end panel being placed into position and the locking flaps being slid by the interior end panel.
Figure 4:
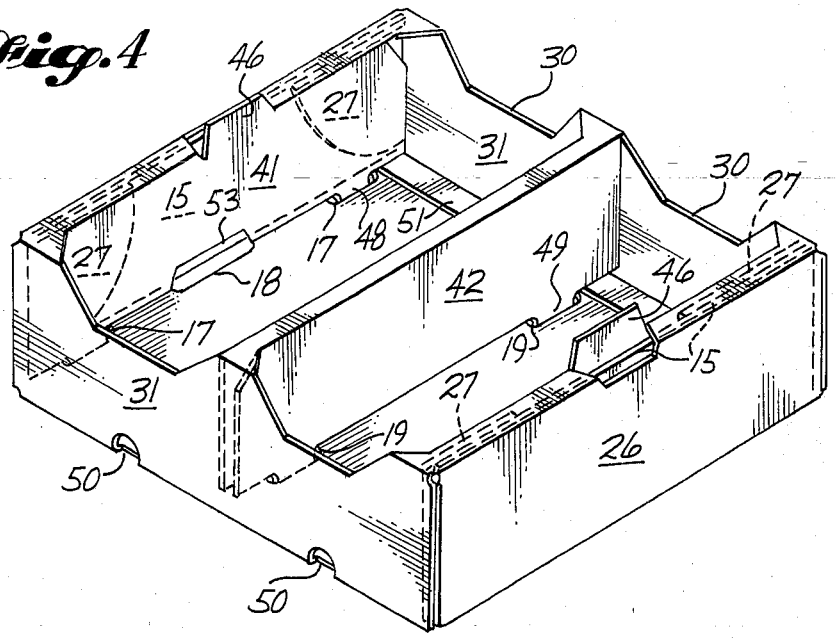
FIGS. 4 and 5 are isometric views of the formed tray.
Figure 5:
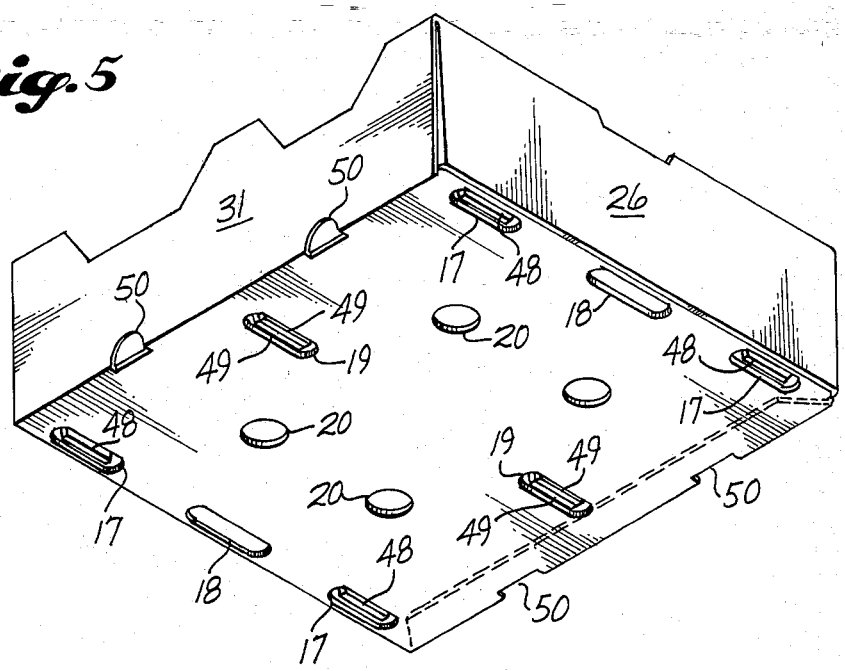

In forming the tray, the tray is set upright as shown in FIG. 2 with the side walls 31 perpendicular to the base panel 16 and the upper tray section 32 parallel to the base panel 16. The interior end walls 15 are bent upwardly until they are upright. The locking flaps 27 are bent inwardly around score lines **25*a* until they are perpendicular to the exterior end walls 26. The exterior end wall 26 is then bent downwardly around score line 21 and the locking flaps 27 inserted into the container between the side walls 31 and the sides of the interior end wall 15. The side edges of the interior and exterior end panels are spaced from the interior faces of the side edges a distance that allows the locking flaps to be inserted into the container. This would usually be the width of the locking flap material or slightly greater than the width of the locking flap material. When the exterior end wall 26 overlies the interior end wall 15, the locking flaps 27 are bent inwardly around score lines 25***b* until they are in contact with the inner face of wall 15. The locking partitions 41 are then bent downwardly around score lines 33 and the locking tabs 48 are inserted into the apertures 17 in the base panel 16. This locks the locking flaps 27 between the interior end wall 15 and the locking partition 41 holding both the interior end wall 15 and the exterior end wall 26 in place and locking the container in its upright position.

The tray is then formed by rotating the central partitions 42 downwardly around score lines 38, and inserting the locking tabs 49 into the locking apertures 19 in the base panel 16.

When the locking partitions 41 are locked into place, the stacking tabs 46 extend above the upper panel 40 of the tray. These stacking tabs will extend through the apertures 18 in the base panel of the next tray above when the trays are stacked. There is a relief section 53 in the lower edge of the locking partitions 41 formed by the central aperture 36. This will accommodate the stacking tab 46 of the tray below.

Figure 6:
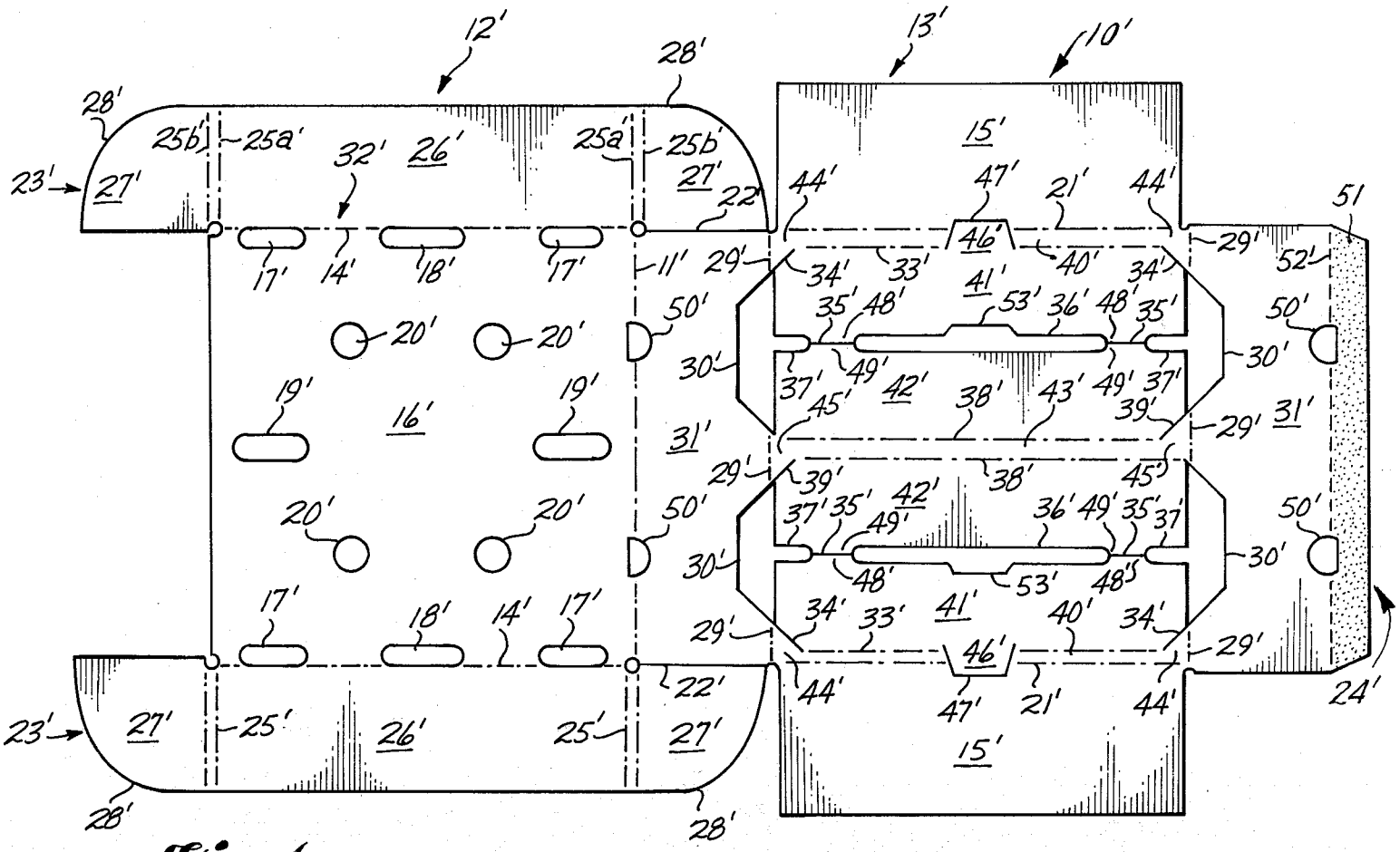
FIG. 6 is a top plan view of a blank of a modified form of tray.

In the construction shown, the interior end wall 15 is hinged to the base panel 16 and the exterior end wall 26 and its locking flaps 27 are hinged to the outer upper panel 40. The interior and exterior end walls 15 and 26 may be reversed. The interior end wall 15 may be hinged from the outer upper panel 40 of the tray and the exterior end wall 26 and its associated locking flaps 27 may be hinged from the base panel 16 of the tray. The interior end walls are hingedly connected to the ends of either the base or upper panels, and the exterior end wall is connected to the other of the base or upper panels. The locking flaps are hingedly connected to the side edges of the exterior end walls. This is shown in FIG. 6.

We claim:

1. A tray comprising
a base panel,
side walls extending upwardly from said base panel,
an upper panel extending between said side walls and being parallel to said base panel,
interior end walls hingedly connected to the ends of one of said panels,
an exterior end wall connected to the ends of the other of said panels,
the inner face of said exterior end wall being contiguous with the exterior face of said interior end wall,
locking flaps hingedly connected only to the side edges of said exterior end walls, said locking flaps being bent around said interior end walls and being contiguous with the interior face of said interior end walls,
a locking partition hingedly connected to the upper panel at each end of said tray, said locking partitions being adjacent said end walls,
locking tabs on the lower edges of said locking partitions,
locking apertures in said base panel aligned with said locking tabs, said locking tabs fitting into said locking apertures and said locking partition holding said locking flaps against the interior face of said interior end wall.

2. The tray of claim 1 further comprising
a stacking tab extending upwardly from the upper edge of said locking partition, and
a stacking aperture in the base panel aligned with said stacking tab.

3. The tray of claim 2 further comprising
a relief in the lower edge of said locking partition, said relief being aligned with said stacking tab.

4. The tray of claim 1 in which
the outer edges of said locking flaps are curved to allow them to be inserted into said tray.

5. The tray of claim 1 further comprising
a central transverse upper panel,
partitions extending downwardly from said upper panel,
locking tabs on the lower edge of said partitions extending into central apertures in said base panel.

6. A blank for tray comprising
a base panel, a first side wall, an upper panel, and a second side wall connected by longitudinal score lines,
means for attaching said base panel to said second side wall,
a pair of first end walls connected by first transverse score lines to the ends of said base panel,
a pair of second end walls connected by second transverse score lines to the ends of said upper panel,
locking flaps connected only to the side edges of one pair of said end walls by additional score lines,
score lines spaced inwardly and adjacent the ends of said upper panel,
locking partitions hingedly attached to said upper panel by said latter score lines,
said locking partitions being substantially equal in height to said side walls,
locking tabs extending from the bottom edge of said locking partitions,
locking apertures adjacent the ends of said base panel, said locking apertures being aligned with said locking tabs in the erect container.

7. The blank of claim 6 further comprising
a cut centrally of said upper panel extending between said locking partition and said second end wall, said cut defining a stacking tab attached to said locking partition,
a stacking aperture in said base panel aligned with said stacking tab in the erect container.

8. The blank of claim 6 further comprising
central score lines extending transversely of said upper panel defining a central upper panel, central partitions hingedly attached to said central upper wall along said latter score lines, said central partitions being equal in height to said side walls and having locking tabs extending from their lower edges,
locking apertures centrally of said base panel aligned with said central partition locking tabs in said erect container.

9. The tray of claim 1 in which said interior end walls have squared side edges.

10. The tray of claims 1, 2, 3, 4, 5 or 9 in which
said interior end walls are hingedly connected to said base panel, and
said exterior end walls are hingedly connected to said upper panel.

11. The tray of claims 1, 2, 3, 4, 5 or 9 in which
said exterior end walls are hingedly connected to said base panel, and
said interior end walls are hingedly connected to said upper panel.

12. The blank of claim 6 in which said locking flaps have squared side edges.

13. The blank of claims 6, 7, 8 or 12 in which said locking flaps are connected to said first end walls.

14. The blank of claims 6, 7, 8 or 12 in which said locking flaps are connected to said second end walls.

* * * * *

Disclaimer 4,347,969.—*William E. Kost* and *Norman Schoeneerger, Jr.*, Tampa, Fla. TRAY. Patent dated Sept. 7, 1982. Disclaimer filed Nov. 15, 1982, by the assignee, *Weyerhaeuser Co.*

Hereby enters this disclaimer to all claims of said patent.

[*Official Gazette January 4, 1983.*]